US009133667B2

(12) United States Patent
Jones et al.

(10) Patent No.: US 9,133,667 B2
(45) Date of Patent: Sep. 15, 2015

(54) DRILL BIT FOR BORING EARTH AND OTHER HARD MATERIALS

(75) Inventors: Mark L. Jones, Draper, UT (US); Kenneth M. Curry, South Jordan, UT (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 406 days.

(21) Appl. No.: 13/455,833

(22) Filed: Apr. 25, 2012

(65) Prior Publication Data

US 2012/0267173 A1 Oct. 25, 2012

Related U.S. Application Data

(60) Provisional application No. 61/478,874, filed on Apr. 25, 2011.

(51) Int. Cl.

| | |
|---|---|
| ***E21B 10/43*** | (2006.01) |
| ***E21B 10/633*** | (2006.01) |
| ***E21B 10/567*** | (2006.01) |

(52) U.S. Cl.

CPC ..... *E21B 10/43* (2013.01); *E21B 10/5673* (2013.01); *E21B 10/633* (2013.01)

(58) Field of Classification Search

CPC . E21B 10/567; E21B 10/5673; E21B 10/633; E21B 10/43

USPC ..... 175/428, 430, 431, 435, 413

See application file for complete search history.

(56) References Cited

U.S. PATENT DOCUMENTS

| | | | | |
|---|---|---|---|---|
| 1,873,814 | A | | 8/1932 | Brewster |
| 3,519,309 | A | | 7/1970 | Engle |
| 4,106,578 | A | * | 8/1978 | Beyer ..... 175/407 |
| 4,337,980 | A | | 7/1982 | Krekeler |
| 4,440,247 | A | | 4/1984 | Sartor |
| 4,485,655 | A | | 12/1984 | Ewing |
| 4,694,916 | A | | 9/1987 | Ford |
| 4,782,903 | A | | 11/1988 | Strange |
| 4,813,501 | A | | 3/1989 | Mills et al. |
| 4,815,342 | A | | 3/1989 | Brett et al. |
| 4,991,670 | A | | 2/1991 | Fuller et al. |
| 5,099,929 | A | | 3/1992 | Keith et al. |
| 5,238,075 | A | | 8/1993 | Keith et al. |
| 5,366,031 | A | | 11/1994 | Rickards |
| 5,427,191 | A | | 6/1995 | Rickards |
| 5,735,360 | A | * | 4/1998 | Engstrom ..... 175/391 |
| 5,906,245 | A | | 5/1999 | Tibbitts et al. |
| 6,003,623 | A | * | 12/1999 | Miess ..... 175/430 |

(Continued)

FOREIGN PATENT DOCUMENTS

WO WO 2010/099512 A1 9/2010

*Primary Examiner* — Cathleen Hutchins

(74) *Attorney, Agent, or Firm* — John C. Bacoch; Brinks Gilson & Lione

(57) ABSTRACT

A drill bit for drilling a hole through earth and hard materials, the drill bit including a bit body having an inner bore and a cutting head at a cutting end, the cutting head including a center portion with one or more apertures extending from the cutting end to the inner bore, a perimeter portion projecting radially outward to form a plurality of blades divided by a plurality of junk slots, a cutting face, and a plurality of cutter receptacles spaced about the cutting face. A plurality of cutters with cutter tips terminating in points are in mounted into the cutter receptacles at a pitch angle relative to the cutting face, and with the plurality of cutter points together defining a projected cutting surface.

20 Claims, 11 Drawing Sheets

(56) References Cited

U.S. PATENT DOCUMENTS

| | | | | |
|---|---|---|---|---|
| 6,109,368 | A | 8/2000 | Goldman et al. | |
| 6,131,673 | A | 10/2000 | Goldman et al. | |
| 6,246,974 | B1 | 6/2001 | Jelley et al. | |
| 6,695,073 | B2 | 2/2004 | Glass et al. | |
| 6,942,045 | B2 | 9/2005 | Dennis | |
| 7,693,695 | B2 | 4/2010 | Huang et al. | |
| 7,882,907 | B2 | 2/2011 | Engstrom | |
| 8,336,649 | B2 | 12/2012 | Jones et al. | |
| 8,439,136 | B2 | 5/2013 | Jones et al. | |
| 2002/0112894 | A1* | 8/2002 | Caraway | 175/385 |
| 2007/0261890 | A1 | 11/2007 | Cisneros | |
| 2008/0035387 | A1 | 2/2008 | Hall et al. | |
| 2009/0000828 | A1 | 1/2009 | Hall et al. | |
| 2009/0020339 | A1 | 1/2009 | Sherwood, Jr. | |
| 2010/0059288 | A1 | 3/2010 | Hall et al. | |
| 2010/0218999 | A1 | 9/2010 | Jones et al. | |
| 2010/0230175 | A1 | 9/2010 | Engstrom | |

* cited by examiner

DRILL BIT FOR BORING EARTH AND OTHER HARD MATERIALS

PRIORITY CLAIM

This application claims the benefit of and priority from U.S. Provisional Patent Application No. 61/478,874 filed on Apr. 25, 2011 that is incorporated in its entirety for all purposes by this reference.

FIELD

The present application relates to drill bits used to bore through earth, concrete and other hard materials.

BACKGROUND

Specialized drill bits are used to drill wellbores, boreholes, and other holes in the earth for a variety of purposes, including water wells, oil and gas wells, injection wells, geothermal wells, monitoring wells, holes used in mining, and the like. These drill bits come in two common types: roller cone drill bits and fixed cutter drill bits.

Well bores and other holes in the earth are typically drilled by attaching or connecting a drill bit to a means of rotating the drill bit. The drill bit can be attached directly to a shaft that is rotated by a motor, engine, drive, or other means of providing torque to rotate the drill bit. In oil and gas drilling, for example, the drill bit is typically connected to the lower end of a drill string that is in turn, connected at the upper end to a motor or drive at the surface, with the motor or drive rotating both the drill string and the drill bit together. The drill string typically comprises several elements that may include a special down-hole motor configured to provide additional or, if a surface motor or drive is not provided, the only means of turning the drill bit. Special logging and directional tools to measure various physical characteristics of the geological formation being drilled and to measure the location of the drill bit and drill string may be employed. Additional drill collars, heavy, thick-walled pipe, typically provide weight that pushes the drill bit into the formation. Finally, the drill pipe connects these elements (e.g. the drill bit, down-hole motor, logging tools, and drill collars, etc.) to the surface where a motor or drive mechanism rotates the entire drill string and, consequently, the drill bit, to engage the drill bit with the geological formation to drill the wellbore deeper.

As a wellbore is drilled, a fluid, typically a water or oil based fluid referred to as drilling mud, is pumped down the drill string through a bore of the drill pipe and any other elements present and through the drill bit. Other types of drilling fluids may be used, including air, nitrogen, foams, mists, and other combinations of gases, and for purposes of this application drilling fluid and/or drilling mud refers to any type of drilling fluid, including gases. In other words, drill bits typically have a fluid channel within the drill bit to allow the drilling mud to pass through the drill bit and out one or more jets, ports, or nozzles. The purpose of the drilling fluid is to cool and lubricate the drill bit, stabilize the wellbore from collapsing, to prevent any fluids present in the geological formation from entering the wellbore, and to carry the fragments and cuttings removed by the drill bit up an outer annulus between the drill string and the wellbore and out of the wellbore. While the drilling fluid is pumped through the inner bore of the drill string and out of the drill bit in a typical drill application, drilling fluid can be reverse-circulated. That is, the drilling fluid can be pumped down the outer annulus (e.g. the space between the exterior of the drill pipe and the wall of the wellbore) of the wellbore, across the face of the drill bit, and into the inner fluid channels of the drill bit through the jets or nozzles and up into the drill string.

Roller cone bits typically include at least two roller cones that have a plurality of cutting elements disposed on a surface of the roller cone. Legs extend from a forward end of the roller cone bit and secure the roller cones about their axes, leaving them free to rotate. In operation, as the drill bit is rotated, the roller cones contact a formation and the difference in angular velocity between the formation and the roller cone bit causes the roller cones to rotate about their axis. The cutters impact the formation as the roller cone rotates, crushing the formation. The cutters may be formed of a hardened material or have a coating of a hard material such as polycrystalline diamond.

Fixed cutter drill bits typically include a plurality of cutters, such as very durable polycrystalline diamond compact (PDC) cutters, tungsten carbide cutters, natural or synthetic diamond, or combinations thereof. These bits are referred to as fixed cutter bits because they employ cutting elements positioned on one or more fixed blades in selected locations or randomly distributed. Fixed cutter bits slide against the formation to remove the rock through a shearing operation. Through varying improvements, the durability of fixed cutter bits has improved sufficiently to make them cost effective in terms of time saved during the drilling process when compared to the higher up-front cost to manufacture the fixed cutter bits.

Recent advances in drilling and production technology include the drilling of one or more horizontal sections and/or offshoots that extend laterally away from a single vertical wellbore, to provide greater access to a laterally-disposed geologic formation of interest. The technology often includes the strategic placement of artificial plugs within the wellbore or an offshoot to temporarily isolate a particular section of the geologic formation adjacent the well for hydraulic fracturing, or "fracking". Once the fracturing process is complete, these same plugs, which may typically be made from a combination of materials such as fiberglass, composite carbon fiber, steel, aluminum, cast iron and other materials that must be drilled out to allow the oil, gas or water to flow from the fractured formation back towards the primary wellbore. In a similar fashion, concrete "shoes" can also be placed in the well from time to time to seal off various portions of the wellbore, and which must later be drilled out or removed.

Typically, it is difficult to drill out or remove the artificial plugs and concrete shoes with the same type of drill bits that were used to drill the well in the first place. One reason is because the hard materials used in the artificial plugs are much more resistant and harder to drill efficiently when using a roller cone bit. Typical fixed-bladed drill bits with PDC cutters also may not cut the hard material effectively because these same hard materials can interact chemically with the PDC element bit to increase their susceptibility to brittle facture and premature wear, thereby rendering a PDC cutter-equipped drill bit less effective. Additionally, the hard material may be too hard for the PDC element to cut effectively and may damage the PDC elements.

A similar situation can arise, moreover, while drilling a borehole below the surface of an urban environment in order to create a utility passage, such as that used for water, sewer and natural gas piping, or conduit for electrical power and fiber optic cable networks. A drill bit used in urban applications could reasonably expect to encounter an underground formation comprising a mix of earth, concrete, steel and asphalt materials, etc., and which can be problematic for drill bits configured primarily for drilling rock.

Thus, there exists a need for a cost-effective and robust drill bit that can better drill through a variety of natural and/or man-made formations or objects, including earth, steel, aluminum, concrete, cast iron, and other hard materials.

SUMMARY

Embodiments of the present invention include a drill bit for drilling a hole through earth and hard materials. The drill bit includes a bit body having a connection means at a connection end, a cutting head at a cutting end, and an inner bore extending from the connection end towards the cutting end. The cutting head further includes a center portion with one or more apertures extending from the cutting end to the inner bore, a perimeter portion projecting radially outward to form a plurality of blades divided by a plurality of junk slots, a cutting face, and a plurality of cutter receptacles spaced about the cutting face. A plurality of cutters with cutter tips terminating in cutter points are mounted into the cutter receptacles at angles of attack relative to the cutting head, so that the plurality of cutter points of all the cutters together define a projected cutting surface.

Other configurations of the cutting head, blades, junk slots, and cutters are disclosed herein and fall within the scope of the disclosure. Moreover, methods of manufacturing the various embodiments of the drill bit are also disclosed herein.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

Features and advantages of the present invention will be apparent from the detailed description that follows, and when taken in conjunction with the accompanying drawings together illustrate, by way of example, features of the invention. It will be readily appreciated that these drawings merely depict representative embodiments of the present invention and are not to be considered limiting of its scope, and that the components of the invention, as generally described and illustrated in the figures herein, could be arranged and designed in a variety of different configurations. Nonetheless, the present invention will be described and explained with additional specificity and detail through the use of the accompanying drawings, in which.

Figure 1:
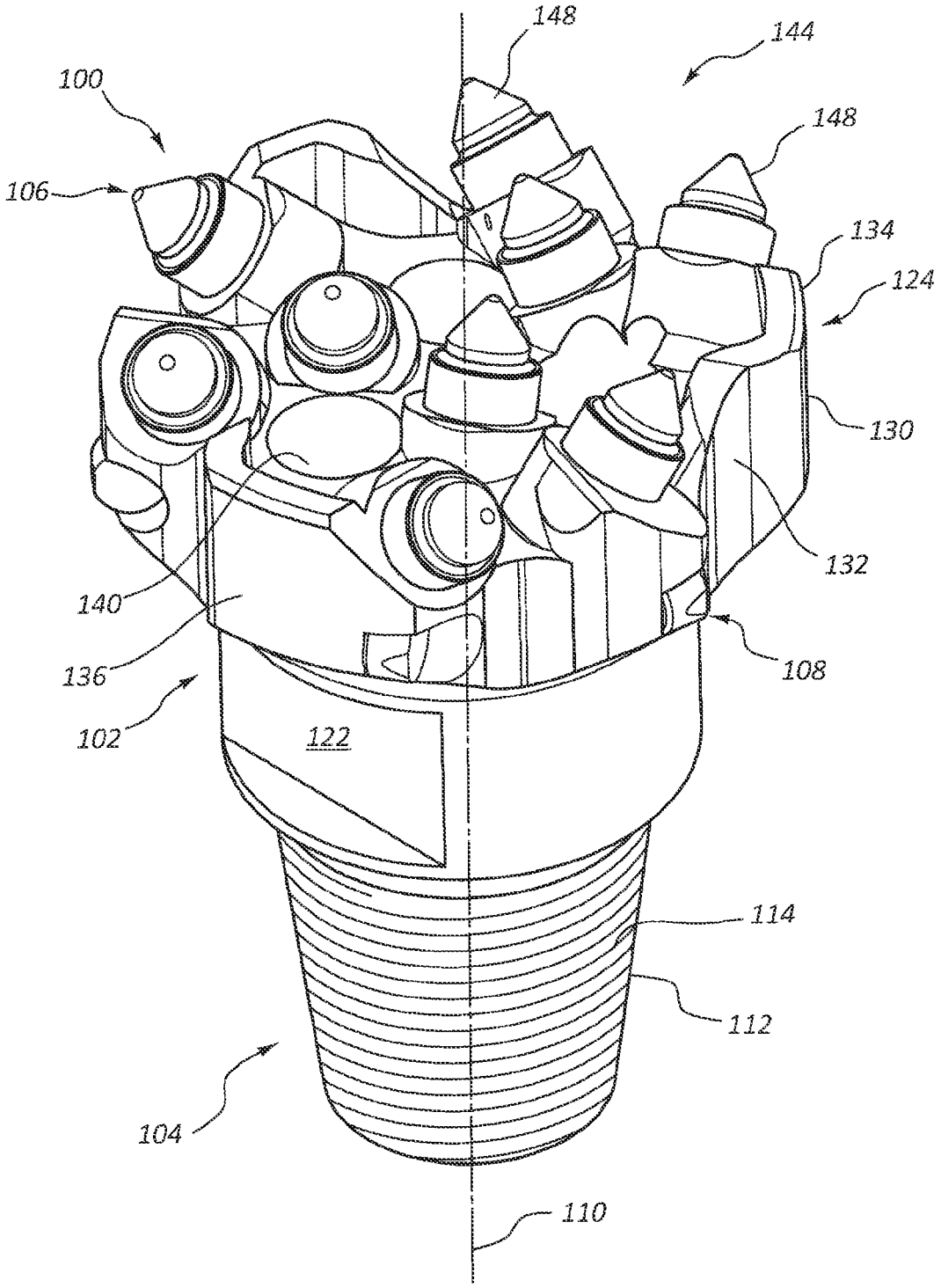
FIG. 1 is a perspective view of a drill bit, in accordance with a representative embodiment of the present invention.

The drawings are not necessarily to scale.

DETAILED DESCRIPTION

The following detailed description makes reference to the accompanying drawings, which form a part thereof and in which are shown, by way of illustration, various representative embodiments in which the invention can be practiced. While these embodiments are described in sufficient detail to enable those skilled in the art to practice the invention, it should be understood that other embodiments can be realized and that various changes can be made without departing from the spirit and scope of the present invention. As such, the following detailed description is not intended to limit the scope of the invention as it is claimed, but rather is presented for purposes of illustration, to describe the features and characteristics of the representative embodiments, and to sufficiently enable one skilled in the art to practice the invention. Accordingly, the scope of the present invention is to be defined solely by the appended claims.

Furthermore, the following detailed description and representative embodiments of the invention will best be understood with reference to the accompanying drawings, wherein the elements and features of the embodiments are designated by numerals throughout.

DEFINITIONS

In describing and claiming the present invention, the following terminology will be used.

The singular forms "a," "an," and "the" include plural references unless the context clearly dictates otherwise. Thus, for example, reference to "a cutter" includes reference to one or more of such structures, and reference to "the carbide material" includes reference to one or more of such materials.

As used herein, "substantially" refers to a degree of deviation that is sufficient to provide an effect that the material or characteristic was intended to provide. The exact degree of deviation allowable may in some cases depend on the specific context. Similarly, "substantially free of" or the like refers to the lack of an identified element or agent in a composition. For example, elements that are identified as being "substantially free of" are either completely absent from the composition, or are included only in amounts which are small enough so as to have no measurable effect on the composition.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, and sub-ranges such as 10 to 50, 20 to 100, etc.

Representative Embodiments of the Invention

Illustrated in FIGS. 1-17 are several representative embodiments of a drill bit for boring earth, cement, concrete and other hard materials, which representative embodiments may also include various methods for making or using the drill bit. FIG. 18 illustrates a general schematic of a drill string 1800 having a drill bit 1802 disposed at its bottom end. For the sake of clarity, the drill bit 1802 is shown enlarged relative to the drill string 1800. The drill string 1800 is suspended from a drill rig 1804 and extends into a wellbore 1808. An annulus 1810, or space between the drill string and the wellbore, may have drilling fluid pumped through it. The drill bit 1802 is useful for drilling out hard material 1806 such as artificial plugs, concrete shoes or similar hard structures and obstructions located in oil, gas, geothermal, injection, and water wells. The drill bit 1802 is also useful for drilling boreholes through underground formations which may include a combination of earth, concrete, steel, asphalt and other hard materials, etc., such as those boreholes used for utility-related conduit and piping. As described herein below, embodiments of the drill bit 1802 provides several significant advantages and benefits over other devices and methods for boring through earth, concrete and other hard materials. However, the recited advantages are not meant to be limiting in any way, as one skilled in the art will appreciate that other advantages may also be realized upon practicing the invention.

FIGS. 1-6 illustrate various views and features of one representative embodiment of a drill bit 100 for boring hard materials. The drill bit 100 includes a bit body 102 having a first end 104, a second end 106 spaced apart from the first end 104, a middle section 108 between the first end 104 and the second end 106, and a longitudinal axis 110 (shown in FIG. 2). The first end 104 of the bit body 102 includes a shank 112 or connection means that is configured to couple or mate the drill bit 100 to a drill string or shaft that is coupled to a rotation means for providing rotary torque or force to the drill bit 100, such as a topside motor, a downhole motor, an engine, turbine, or other type of drive that also located near the surface, or some other rotation means, as described above in the background.

Figure 2:
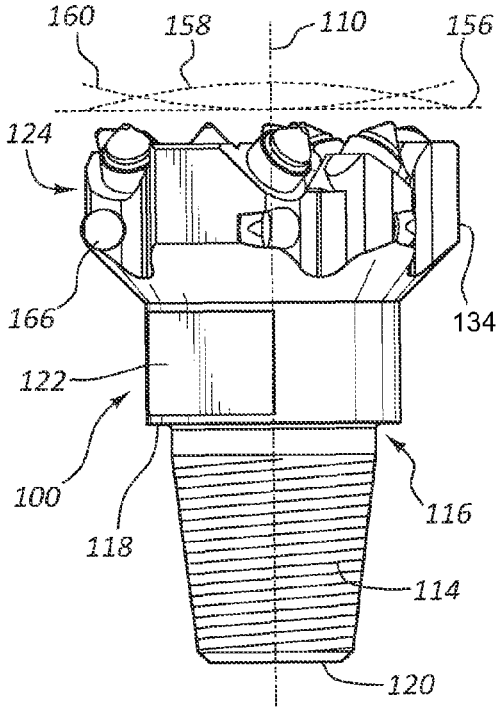
FIG. 2 is a side view of the embodiment of FIG. 1.

As shown in FIGS. 1 and 2, for example, the shank 112 of the drill bit 100 may include a typical pin connection with a thread 114 that has a chamfer 120 configured to reduce stress concentrations at the end of the thread 114 and to ease mating with a box connection in the drill string, a shank shoulder 116, and the sealing face 118 of the connection. The thread 114 is typically of a type described as an American Petroleum Institute (API) standard connection of various diameters as known in the art, although other standards and sizes fall within the scope of the disclosure. The thread 114 is configured to operably couple with a thread of a corresponding or analogue box connection in the drill string, collar, downhole motor, or other connection to the drill bit 100 as known in the art. The sealing face 118 provides a mechanical seal between the drill bit 100 and the drill string and inhibits drilling fluid passing through the inner bore of the drill string and the inner bore of the drill bit 100 from leaking.

Figure 7:
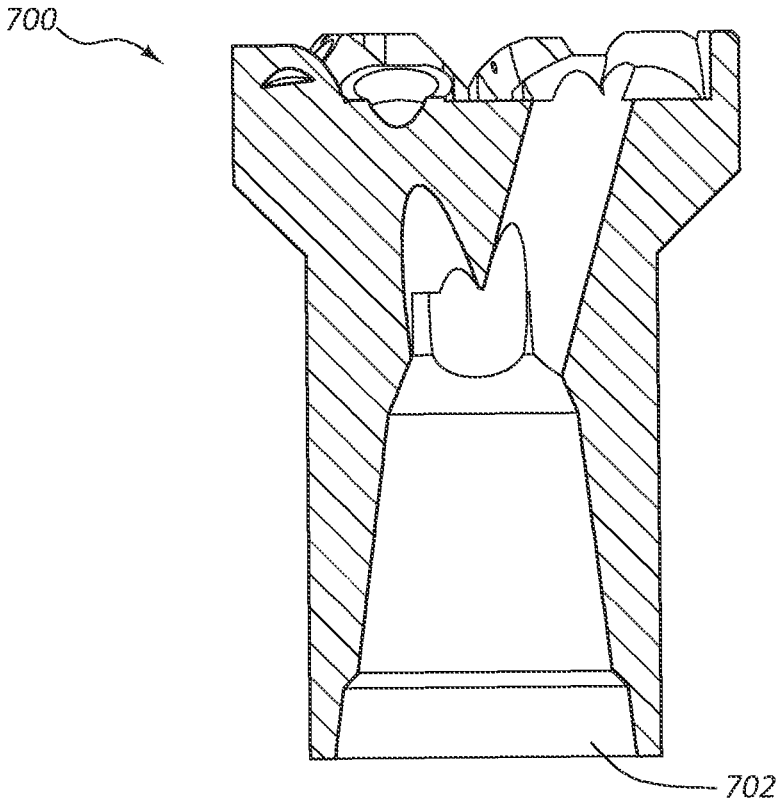
FIG. 7 is a cross-sectional side view of a drill bit, in accordance with another representative embodiment.

Referring briefly to FIG. 7, an embodiment of a drill bit 700 is illustrated that incorporates a box connection 702, rather than the pin connection described above. The box connection 702 configuration is less common, although it still falls within the scope of this disclosure. The box connection 702 has an internal thread (not shown) similar to the external thread of the pin connection. The box connection 702 typically is of a type described as an American Petroleum Institute (API) standard connection of various diameters as known in the art, although other standards and sizes fall within the scope of this disclosure. The thread of the box connection is configured to operably couple with the thread of a corresponding or analogue pin connection in the drill string, collar, downhole motor, or other connection to the bit as known in the art. Of course, the connection means can also be bolts, a welded connection, joints, and other means, etc., of connecting the drill bit to a motor, drill string, drill, top drive, downhole turbine, or other means of providing a rotary torque or force.

Returning to FIGS. 1-6, the middle section 108 has a breaker slot 122 formed therein that is configured to accept a bit breaker. The bit breaker is used to connect or mate the drill bit 100 to the drill string and provides a way to apply torque to the drill bit 100 (or to prevent the drill bit 100 from moving as torque is applied to the drill string) while the drill bit 100 and the drill string are being coupled together or taken apart.

The bit body 102 further includes a cutting head 124 located at the second end 106, and which cutting head 124 may be spaced from the shank 112 by the middle section 108, such as the cylindrical middle section 108 illustrated in FIGS. 1-6. A forward face of the cutting head 124 defines a cutting face 144. The cutting head 124 may include both a center portion 126 and a perimeter portion 128, with the perimeter portion 128 projecting radially outward from the longitudinal axis 110 beyond the cylindrical middle section 108 of the bit body 102. The perimeter portion 128 may have an outer radial surface 130 and a plurality of junk slots 132 extending radially inward from the outer radial surface 130 to divide the perimeter portion 128 of the cutting head 124 into a plurality of blades 134.

The outer radial surface 130 at the outer ends of the plurality of blades 134 may include a gauge pad 136 that is proximate the greatest radial extent of the drill bit 100 from the longitudinal axis 110, or one-half the drill bit diameter 138, of the drill bit 100. The gauge pad 136 may include gauge protection, such as hard-facing and/or a selected pattern of tungsten carbide or other hard materials to provide increased wear-resistance to the gauge pad 136 thereby increasing the probability that the drill bit 100 substantially retains its gauge diameter, which may be the drill bit diameter 138. The gauge pad 136 may also include a crown chamfer that provides a transition between the perimeter portion 128 of the cutting head 124 and the middle section 108 of the bit body 102.

Figure 2A:
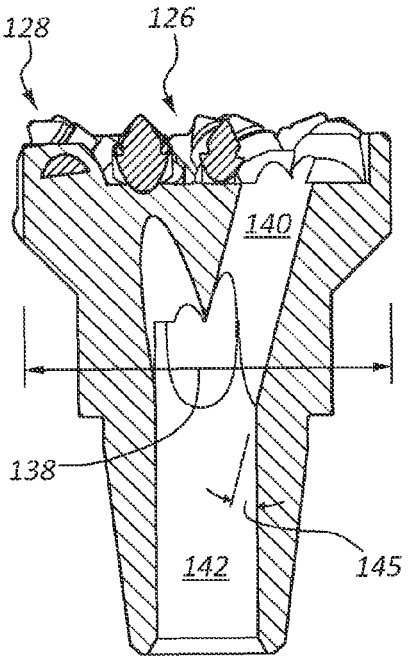
FIG. 2A is a cross-sectional side view of the embodiment of FIG. 1, as viewed from section line A-A in FIG. 3.

As shown in FIG. 2A, the bit body 102 also has an inner bore 142 which extends from the first end 104 towards the second end 106 of the bit body 102. Additionally, the center portion 126 of the cutting head 124 includes one or more apertures 140 extending from the cutting face 144 to the inner bore 142, thereby allowing a drilling fluid to pass outwardly from the inner bore 142 to the cutting face 144 in a standard flow embodiment, or inwardly from the cutting face 144 to the inner bore 142 of the drill bit in a reverse flow embodiment. While the inner bore 142 may be centered around the longitudinal axis 110 of the bit body 102 as shown in FIG. 2A, the apertures 140 may or may not be centered about the longitudinal axis 110 of the bit body 102, and may instead have a proximal end intersecting with the inner bore 142 at an angle 145 and a distal end opening into the cutting face 144 proximate the center portion 126 of the cutting head 124 at a location that is offset from the longitudinal axis 110. In other embodiments, the apertures 140 may follow a curved path from the inner bore 142 to an offset opening in the cutting face 144 of the cutting head 124.

Figure 5:
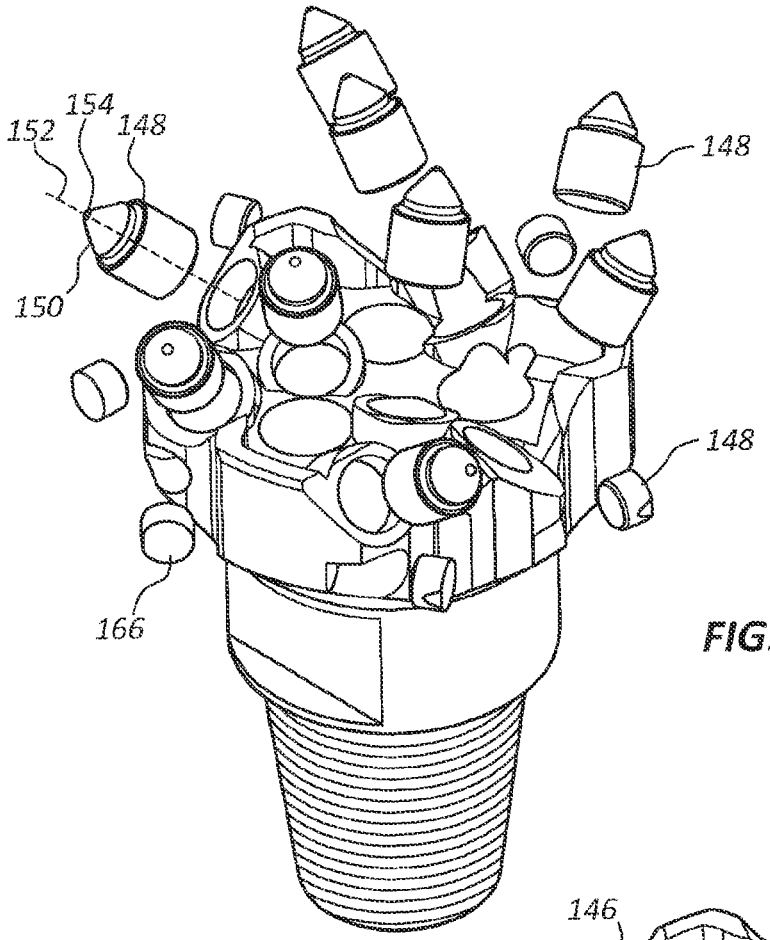
FIG. 5 is an exploded perspective view of the embodiment of FIG. 1.
Figure 6:
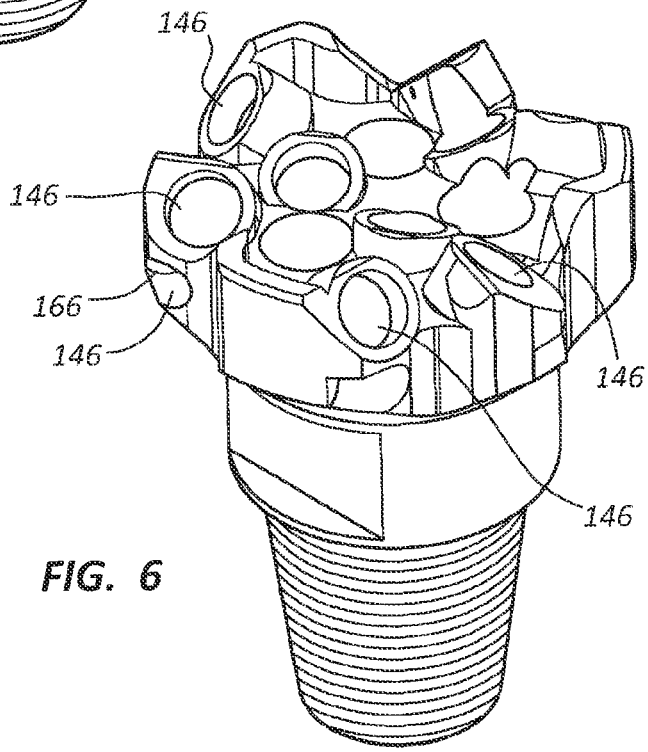
FIG. 6 is a perspective view of the bit body of the embodiment of FIG. 1.

As shown with more detail in FIGS. 5 and 6, a plurality of cutter receptacles 146 may be formed into the second end 106 of the drill bit 100 and spaced about both the center portion 126 and the perimeter portion 128 of the cutting face 144 of the cutting head 124. The cutter receptacles 146 may be blind holes or through holes, and may be sized and shaped to receive a plurality of cutters 148. For example, the cutter receptacle 146 may be sized and shaped to receive a cutter 148 in a press fit or a braze joint for a fixed, non-rotating connection between the cutter 148 and the cutting head 124. Alternatively, the cutter receptacle 146 may be sized and shaped to receive a cutter 148 with a loose fit that allows for rotation of the cutter 148 relative to the cutting head 124.

In embodiments in which the cutter 148 is loosely fitted, the cutter 148 may be secured within a through hole cutter receptacle 146 with a retention device (not shown) that is coupled to a back end of the cutter 148 after its installation within the cutter receptacle 146. In embodiments in which the cutter 148 is press fit within the cutter receptacle 146, a diameter of the body of the cutter 148 may be sized slightly larger than a diameter of the cutter receptacle 146, and the metallurgy of both the cutting head 124 and the body of the cutter 148 may be configured with substantially similar coefficients of thermal expansion to maintain the press fit during heating of the drill bit 100 caused by drilling operations. In embodiments in which the cutter 148 is brazed in the cutter receptacle 146, the diameter of the body of the cutter 148 may be sized slightly less than the diameter of the cutter receptacle 146, such as about between 0.001 inch and 0.003 inch, to allow capillary action or similar phenomenon to draw the braze material in fluid form down around the sides and bottom of the cutter 148, to securely bond the cutter 148 within a blind hole cutter receptacle 146 upon cooling of the braze material.

As may be appreciated by one of skill in the art, other forms of attachment of the cutters 148 within the cutter receptacles 146 are also possible, including but not limited to fasteners, adhesives, welding and the like.

Each of the cutters 148 of the drill bit 100 illustrated in FIGS. 1-6 may have a cutter tip 150 centered about a cutter axis 152 and terminating in a cutter point 154, with each of the cutters 148 being mounted into a cutter receptacle 146 at a pitch angle relative to the cutting head 124 and with the cutter tip 150 being pointed in a direction generally toward an intended direction of rotation of the drill bit 100. In one aspect, the pitch angle may be measured relative to a reference line that is perpendicular to the longitudinal axis 110 and intersecting the cutter axis 152, and with the pitch angle being an acute angle opening away from the reference line. In other words, when the longitudinal axis 110 of the bit body 102 is aligned in the vertical direction and the cutter tip 150 is pointed in an intended direction of rotation of the drill bit 100, the pitch angle of the cutter 148 is the acute angle measured between the cutter axis 152 and a horizontal reference plane which intersects the cutter point 154 of the cutter 148.

As will be described in more detail below, the pitch angles of the cutters 148 may be modified to provide a consistent attack angle relative to the direction of motion of the cutter tips 150 when the drill bit 100 is rotating and moving forward while cutting through a hard material or formation.

As best shown in FIG. 2, the plurality of cutter points 154 together define a projected cutting plane or surface, and which projected cutting surface may be a flat projected cutting surface 156, a convex projected cutting surface 158, or a concave projected cutting surface 160, or a close approximation thereof, so as to account for tolerances in manufacturing the drill bit 100 or uneven wear of the cutter tips 152 during operation, etc. In one aspect of the invention, the selection of a drill bit 100 having a flat projected cutting surface 156, convex projected cutting surface 158, or concave projected cutting surface 160 may be performed dependent on the type of hard material or earthen formation to be drilled. In another aspect of the invention, the selection of a drill bit 100 having a flat projected cutting surface 156, convex projected cutting surface 158, or concave projected cutting surface 160 may also be dependent on, at least in part, the use of either a standard flow or reverse flow of drilling fluid with the drill bit 100, and for the control and removal of the cuttings, chips and other detritus away from the cutting face 144 of the bit body 102 and out from the borehole or wellbore. For instance, a concave projected cutting surface 160 may better direct the flow of drilling fluid and cutting debris towards the center of the drill bit 100 in a reverse flow configuration, while a convex projected cutting surface 158 may better direct the flow of drilling fluid and cutting debris towards the perimeter of the drill bit 100 in a standard flow configuration.

Figure 3:
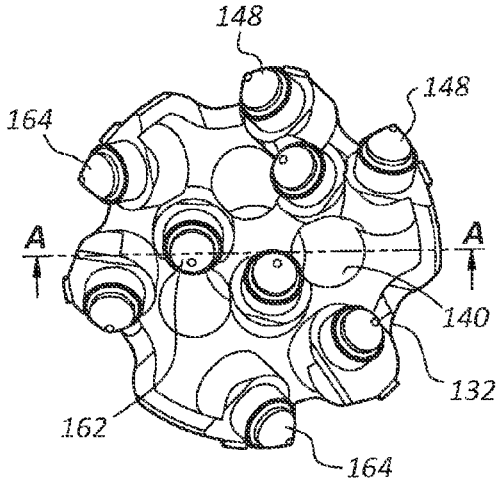
FIG. 3 is a top view of the embodiment of FIG. 1.
Figure 4:
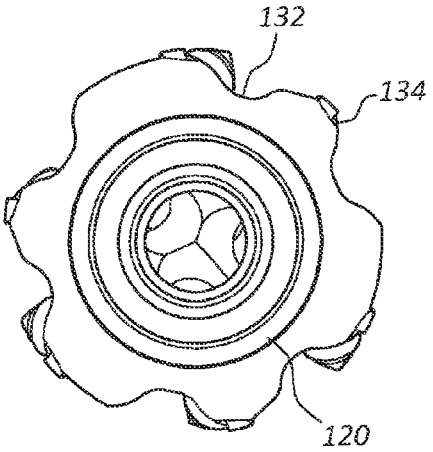
FIG. 4 is a bottom view of the embodiment of FIG. 1.

Referring now to FIG. 3, the plurality of cutters 148 may further include a number of inner cutters 162, with the inner cutters 162 being distributed across the cutting face 144 and configured to cut an end face of the borehole. The plurality of cutters 148 may also include a number of outer cutters 164, with the outer cutters 164 being distributed around a perimeter of the cutting face 144 and angled so that the cutter tips 152 of the outer cutters 164 extend radially beyond an outermost radial surface of the bit body 102 to cut the inner sidewall of the borehole.

In some embodiments, at least one third of the plurality of cutters 148 installed into the cutting face 144 can be outer cutters 164. For example, in the embodiment of FIGS. 1-6 and 9-10, nine cutters 148 can be mounted into cutter receptacles 146 that are spaced about the cutting head 124, with three of the cutters 148 being outer cutters 164 having cutter tips 152 angled to extend radially beyond the outermost radial surface of the bit body 102 to cut the inner sidewall of the borehole. The other six cutters 148 are inner cutters 162 that are distributed across the perimeter and center portions of the cutting face 144 and configured to cut the end face of the borehole.

Also shown in FIG. 3 are three apertures 140 in the cutting head 124 which extend to the inner bore 142 of the bit body 102. The locations of the three apertures 140 may be interspaced within the three inner cutters 162 that are mounted within the center portion 126 of the cutting head 124, so as to provide a drill bit 100 that is substantially balanced. Furthermore, the size of the three apertures 140 may be configured to receive a reverse flow of cutting fluid, in which the drilling fluid is pumped down the outer annulus (the space between the exterior of the drill pipe and the wall of the borehole) of the wellbore, through the junk slots 132 formed in the outer radial surface 130 of the cutting head 124, across the cutting face 144 of the bit body 102, through the apertures 140 and into the inner bore 142 of the drill bit 100, and from thence up the fluid passage in the drill string to the surface.

One advantage of utilizing a reverse flow with the drill bit 100 is that any fragments, cuttings, chips and other detritus produced by the cutting head 124 can be carried away from the cutting face 144 and directly out of the borehole or wellbore and to the surface through the drill string's internal fluid passage, thus preventing any detritus from falling out of the return flow at any bend or irregularity in the borehole or wellbore, which could eventually form a blockage or similar obstruction. To accommodate the fragments, cuttings and chips, the apertures 140 of a reverse flow drill bit may be sized larger than the nozzle passage aperture which may otherwise be used with a standard flow of cutting fluid. Indeed, in one embodiment of the drill bit 100, the total cross-sectional area of the one or more apertures 140 may range from about seventy percent (70%) to about one hundred and thirty percent (130%) of the total cross-sectional area of the inner bore of the drill bit 100.

Also shown in FIGS. 1-6 are a plurality of trim or gauge cutters 166 that may be positioned within the outer radial surfaces 130 or gauge pads 136 of the blades 134. The gauge cutters 166 may be shear cutters mounted in gauge cutter receptacles, and can be used to smooth and finish the inner sidewalls of the borehole after it's being cut by the outer cutters 164 installed in the cutting face 144 of the cutting head 124. In some embodiments, the cutter points 154 of the outer cutters 164 can extend radially beyond the outermost radial edges of the gauge cutters 166 a short distance, such as about 0.020 inches, to ensure that diameter of the borehole is determined by the cutting action of the outer cutters 164. In other embodiments, however, the outermost radial edges of the gauge cutters 166 may extend radially beyond the cutter points 154 of the outer cutters 164, and may provide a finished cut that determines the diameter of the borehole.

Although the gauge cutters 166 in the illustrated embodiment are shown as each gauge cutter 166 being located at the same axial position along the outer radial surface 130 of the cutting head 124, it is to be appreciated that the axial position of the gauge cutters 166 may also be staggered across the gauge pads 136, and that the cutting head 124 may be provided with a greater or lesser number of gauge cutters 166 than the six gauge cutters 166 shown in FIGS. 1-6.

In a reverse flow embodiment of the drill bit 100, such as that illustrated in FIGS. 1-6, the junk slots 132 can be sized to control a flow of drilling fluid into the volume between the cutting face 144 of the drill bit 100 and the end face of the borehole, rather than being sized to accommodate the various fragments, cuttings, chips and other detritus produced by the cutting head while drilling through the underground formation, as with a standard flow configuration. In the reverse-flow embodiment, for instance, the total combined cross-sectional area of all the junk slots 132 can be less than the total cross-sectional area of the one or more apertures 140 in the center portion 126 of the cutting head 124, so as to control the velocity of the cutting fluid as it enters the volume from the perimeter of the cutting head 124. Indeed, in one embodiment of the drill bit 100, the total combined cross-sectional area of all the junk slots 132 range from about seventy-five percent (75%) to about ninety-five percent (95%) of the total cross-sectional area of the one or more apertures 140.

For instance, limiting the size of the junk slots 132 may cause an increase in back pressure of the cutting fluid in the outer annulus that is sufficient to create a nozzle effect in the junk slots 132, which then direct the drilling fluid at high speed from the perimeter of the cutting head 124 against the end face of the borehole to scour the end face of any fragments, cuttings, chips and other detritus. The drilling fluid can then carry the detritus through the apertures 140 in the central portion of the cutting head 124 to the inner bore 142 of the bit body 102, and from thence through the fluid passage located in the center of the drill string to the surface or back end of the drill string. In one representative embodiment, for example, the combined cross-sectional area of all of the junk slots 132 may be equal to or less than the total cross-sectional area of the one or more apertures 140, so as to impart the drilling fluid with a maximum speed as it flows through the cutting volume to carry away the fragments and cuttings produced by the cutting head 124 and to cool and lubricate the cutters 148 mounted in the cutting face 144.

As may be apparent to one of skill in the art, embodiments of the drill bit 100 may have a cutting head 124 with a more compact and solid design. For instance, the 'blades' of the cutting head 124, as defined by the plurality of junk slots 132 extending inward from the outer radial surface of the perimeter portion 128 of the cutting head 124, can be more robust and 'stubbier' than the blades found on other fixed bladed designs. Furthermore, the blades may not extend into the center portion 126 of the cutting head 124, and may only be part of the perimeter portion 128 that projects radially outward beyond the outermost extent of the middle section 108 of the bit body 102. Thus configured, the blades of the drill bit 100 may accommodate a perimeter loading of forces, as may be generated by the outer cutters 148, that is greater than the perimeter loading found in other fixed bladed designs wherein the blades extend axially forward from the second or cutting end 106 of the drill bit 100.

In addition to the compact and robust design, the plurality of blades 134 can be formed integrally with the bit body 102, such as being milled out of a single steel blank. Alternatively, the drill bit blades 134 can be welded to the bit body 102. In yet another embodiment, the bit body 102 and blades 134 can be formed from a matrix sintered in a mold of a desired shape under temperature and pressure, typically a tungsten carbide matrix with a nickel binder, with the blades 134 also being integrally formed with the matrix with the bit body 102. In this case a steel blank in the general shape of the bit body 102 and the blades 134 can be used to form a scaffold and/or support structure for the matrix.

The shank/connection means 112 may also be integrally formed with the bit body 102 from a single steel blank. Alternatively, a steel connection means can be welded or otherwise attached to a bit body 102 with a middle section and cutting head that have been fabricated separately.

Figure 8:
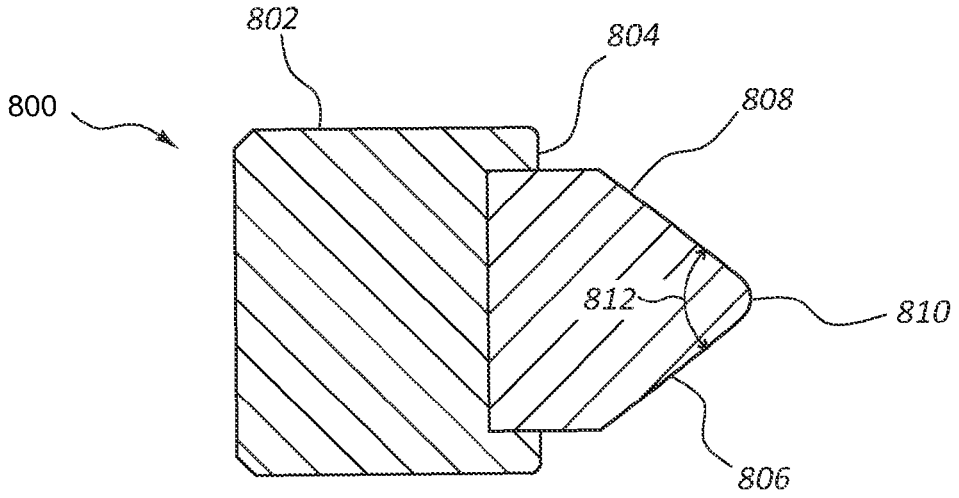
FIG. 8 is a cross-sectional side view of a cutter.

A representative configuration of a cutter 800 is illustrated in FIG. 8. The cutter 800 may include a hardened steel or metallic body 802 bonded at its forward end 804 to a carbide cutter tip 806. The body 802 and/or the cutter tip 806 may be made of a polycrystalline diamond compact (PDC), tungsten carbide, natural, or synthetic diamond, hardened steel, regular steel, and other hard materials or combination of materials, such as the carbide cutter tip 806 in the body 802. In some embodiments, the body and cutter tip may be integrated such that there is no body separate from the cutter tip. The cutter tip may then be received directly in a cutter receptacle. As described above, the outer diameter of the body 802 may be sized for a press fit, a braze fit, or a loose rotating fit within the cutter receptacles formed into the head end of a drill bit. The cutter tip 806 may be made from a single piece of carbide material, such as tungsten carbide or similar material, and may have a conical body 808 terminating in a cutter point 810. Alternatively, the cutter tip 806 may be made from multiple segments of different carbide materials that have been combined to form a composite body.

As shown, the conical body 808 of the cutter tip 806 may include a single-angle linear profile, which may be formed with an included angle 812 that is less than or about ninety degrees, and which conical body 808 may also have a slightly-rounded apex or cutter point 810. Other included angles 812 and degrees of rounding of the cutter point 810 are also possible and may be considered to fall within the scope of the invention. In other embodiments, for example, the cutter tip 806 may include a double-angle linear profile, a multiple-angle linear profile, a continuously-curved profile, whether convex or concave, or combinations thereof, etc.

In the case of a rotating cutter 800, the body 802 of the cutter 800 may include a groove (not shown) at a rear end of the body 802. A removable securing means may be used to secure the cutter 800 in a through-hole cutter receptacle. Typically, the securing means is a clip, such as a C-clip, spring ring, or other contracting and expanding retaining device that clips into the groove to securely retain the cutter 800 in the through-hole and prevent the cutter 800 from falling back from the forward end of the cutter receptacle. An optional plug, such as a threaded plug, could be inserted at the bottom of the through hole to prevent drilling mud and/or other debris from becoming caked within the through hole and to prevent the drilling mud from eroding the rear end of the body 802 of the cutter 800. Other configurations are also possible.

Figure 9:
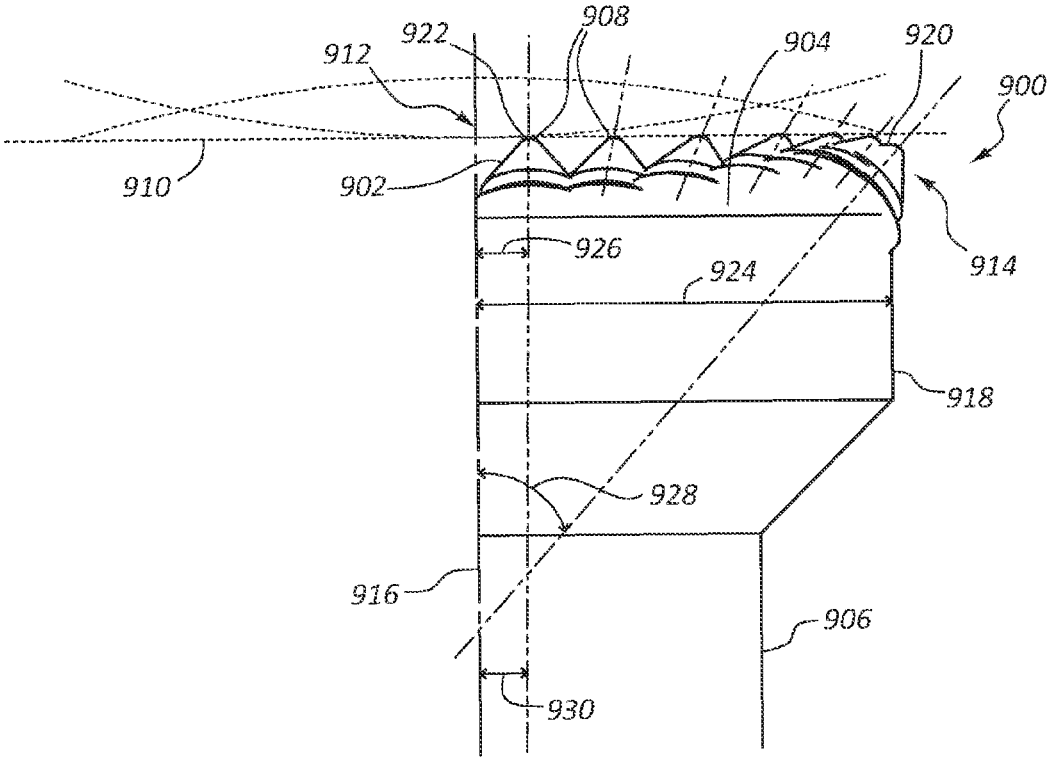
FIG. 9 is a schematic illustration of the cutter head profile of the embodiment of FIG. 1.
Figure 10:
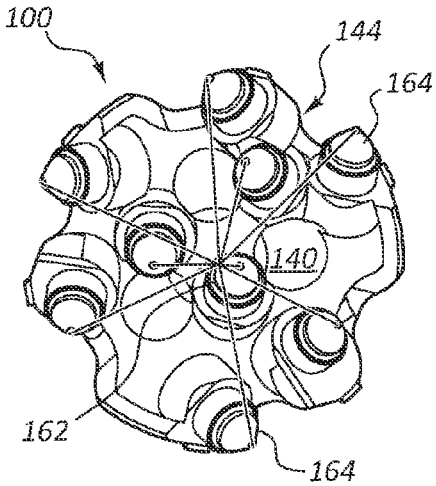
FIG. 10 is a top view of the drill bit showing random cutter placement, in accordance with the embodiment of FIG. 1.

FIG. 9 illustrates profile view of an exemplary cutting head 900. As illustrated the view of FIG. 9, cutters 902 may be installed in cutter receptacles spaced about a cutting face 904 of a bit body 906, so that cutter points 908 or the cutters 902 form a projected cutting surface 910. Cutters 902 may be staggered radially across a center portion 912 and perimeter portion 914 of the cutting head 900 so as to drill against an end face of a borehole. Outer cutters 902 may be distributed at a common radial distance from a longitudinal axis 916 of the cutting head 900 around the perimeter portion 914 of the cutting face 904 and angled so that the cutter points 908 extend radially beyond an outer radial surface 918 of the bit body 906 to cut over the same path through the formation and form a sidewall of the borehole.

As may be appreciated by one of skill in the art, a distance a given cutter 902 travels during a single revolution of the drill bit increases as the radial distance from the cutter 902 to the longitudinal axis 916 of the drill body 906 increases. Thus, a first cutter 920 positioned at a first radial distance 924 from the longitudinal axis 916 travels a greater distance for each revolution of the drill bit than a second cutter 922 positioned at a second radial distance 926 from the longitudinal axis 916 when the second radial distance is less than the first radial distance. As such, the first cutter 920 at the first radial distance 924 would wear faster than the second cutter 922 at the second radial distance 926. In view of this uneven wear, relatively more cutters 902 may be positioned relatively more closely, i.e., with relatively less radial distance separating those cutters 902 at similar radial distances. In other words, the greater the radial distance from the longitudinal axis 916 to the cutters 902, the closer the cutters 902 are spaced, as compared to cutters 902 positioned at relatively shorter radial distances from the longitudinal axis 916.

As can also be seen in FIG. 9, a side rake angle of the cutters 902, as measured from the longitudinal axis 916 of the bit body 906 to the cutter axes, can gradually increase in an outward direction from the cutter 902 located nearest the longitudinal axis 916 of the drill bit towards the plurality of outer cutters 902 located proximate the perimeter portion 914 of the cutting face 904. For example, first side rake angle 928 associated with the first cutter 920 is greater than a second side rake angle 930 associated with the second cutter 922. However, other cutters arrangements are also possible, with the side rake angles of the various inner cutters 902 being approximately zero or even directed inward towards the longitudinal axis 916.

Figures 12A, 12B, 12C:
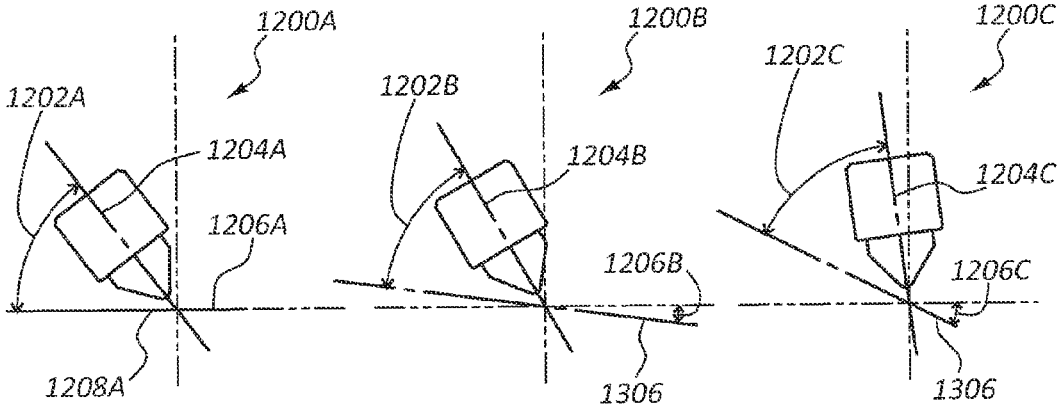
FIGS. 12A-12C are schematic side views of the pitch angle, attack angle, and helix angle of individual cutters relative to the cutting face of the bit body.

Referring now to FIG. 12A, a cutter 1200A may be positioned in a cutter receptacle with a pitch angle 1202A relative to a cutting head of a bit body. The pitch angle 1202A may be chosen based on a combination or sum of a preferred attack angle of the cutter 1200A and a projected helix angle of the cutter 1200A as it moves through a particular formation or material. More specifically, the pitch angle 1202A is the acute angle measured between an axis 1204A of a cutter 1200A and a reference line 1206A perpendicular to a longitudinal axis of the bit body, with a cutter tip 1208A being pointed in a intended direction of rotation of the drill bit. With the drill bit at rest as in FIG. 12A, the pitch angle 1202A and the attack angle are equal for any particular cutter.

However, once the drill bit begins to move forwardly through the formation, the forward motion of the cutter results in the cutter moving in a helical path, which affects the attack angle. The attack angle is the angle of the cutter axis relative to the direction of motion of the cutter tip as it enters the formation. The helix angle is the angle between the end face of the borehole (e.g. the reference line perpendicular to the longitudinal axis of the bit body and intersecting the cutter point) and a path of the cutter tip as it moves forwardly through the formation being drilled by the drill bit.

Figure 13:
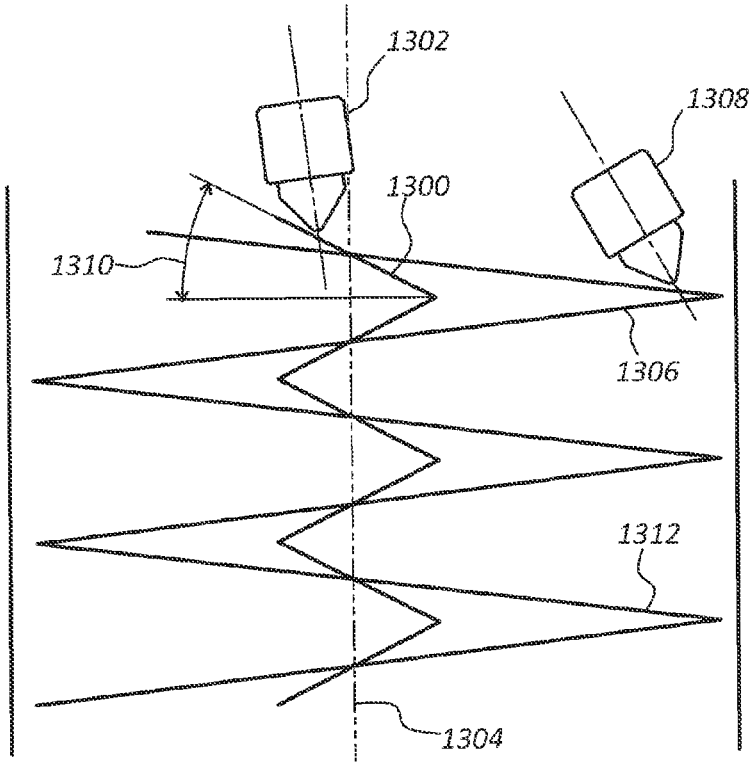
FIG. 13 is a schematic illustration of the pitch angle, attack angle, and helix angle of two cutters as may exist during operation of the drill bit.

The change in the actual attack angle depends upon the rate of penetration of the drill bit and the radial location of the cutter with respect to the longitudinal axis of the bit body. FIG. 13 illustrates an inner path 1300 for an inner cutter 1302 as it rotates about axis 1304 and an outer path 1306 for an outer cutter 1308. As can be seen in FIG. 13, the inner cutter 1302 helix angle 1310 is significantly greater than the outer cuter 1308 helix angle 1312. In effect, this can cause the actual attack angle to become more aggressive.

If instead it is desirable to control the actual angle of attack of each cutter to a more constant value across all of the cutters in the cutting head, the pitch angle of each cutter can be rotated by the anticipated helix angle to a less aggressive orientation, as shown in FIG. 12B. In FIG. 12B, the cutter 1200B is located near the perimeter of the cutting head. Thus, its helical path resembles that of the outer path 1306. The attack angle 1202B is then the angle between the helix angle 1206B and the axis 1204B of the cutter 1200B. In FIG. 12C, the cutter 1200C is located near the axis of the cutting head. Thus, its helical path resembles that of the inner path 1300. The attack angle 1202C is then the angle between the helix angle 1206C and the axis 1204C of the cutter 1200C. Thus, the actual attack angle 1202B of cutter 1200B is similar to the actual attack angle 1202C of cutter 1200C, despite their different helical paths. In embodiments of the drill bit of the present application, the angles of attack of all the cutter tips projecting forwardly from the cutting head can be controlled and optimized for the most effective drilling of any particular hard material.

In order to cut through concrete and other hard materials, the drill bit may be configured for faster rotation by the rotation means for providing rotary torque or force, as described above. For instance, a typical range of rotational speeds for a fixed bladed drill bit with PDC cutters can range from 60 rpm to 150 rpm. In contrast, a typical range of rotational speeds for the drill bit described herein can range from about 60 rpm up to about 500 rpm. At these higher speeds, in combination with the more-compact design of the cutting head and the controlled attack angles of the cutters, the cutter is able to drill through hard materials with a machining-like action, similar to a combination of milling/cutting, and without extreme wear or damage to the cutters. For example, the cutter is able to plow a path through the formation with the cutter tip. The formation may then degrade around the plowed path and may chunk or break off in pieces. This is in contrast to a roller cone bit, in which a cutter repeatedly impacts the formation, or a typical fixed cutter bit in which the cutter shears the face of the formation. For instance, the drill bit of the present application has been observed under test conditions to drill through hard material, such as concrete interlaced with rebar, at a far higher penetration rate than a roller cone bit or a fixed cutter bits having a standard earth-boring design configuration. In some embodiments, the cutters of the present invention may be used in combination with a conventional PDC cutter. For example, the cutters described in this application can degrade the formation by way of the plowing action, while a conventional PDC cutter may shear the face of the formation proximate the plowed path.

Referring back to FIG. 10, which is a view of the cutting face 144 of the embodiment of FIGS. 1-6, the outer cutters 164 may be distributed more or less equally around the outer perimeter portion 128 of the cutting head 124, while the inner cutters 162 may be spaced more or less randomly about the cutting face 144 of the cutting head 124 and interspaced with the three apertures 140 for receiving the reverse flow of drilling fluid therein. In one aspect, the inner cutters 162 and apertures 140 can be arranged as to provide a drill bit that is substantially balanced, either mechanically balanced and/or force balanced.

Figure 11:
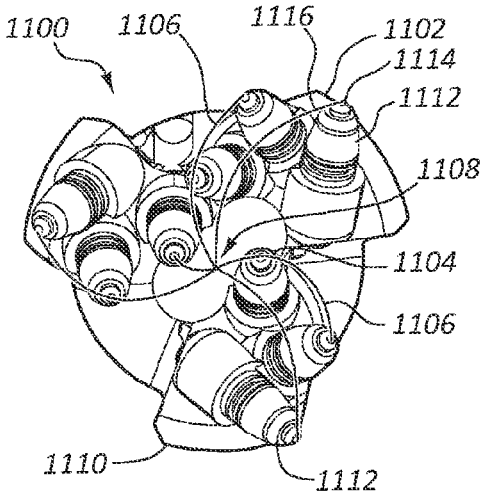
FIG. 11 is a top view of a drill bit showing cutter placement along curved lines, in accordance with another representative embodiment.

Illustrated in FIG. 11 is another embodiment of a drill bit 1100. In this embodiment, a cutting head 1102 has a different arrangement of cutters than the embodiment of FIG. 10. Inner cutters 1104 are distributed along a first set of curved paths 1106 extending across a center portion 1108 and a perimeter portion 1110 of the cutting head 1102. Outer cutters 1112 are located at the ends 1114 of a second set of curves 1116 and in a trailing position relative to the inner cutters 1104 and the direction of rotation of the drill bit 1100. The embodiment of the drill bit 1100 for boring hard materials shown in FIG. 11 is configured for a standard flow of drilling fluid and has smaller apertures opening into the second or cutting end of the bit body and larger junk slots between a reduced number of blades compared to the embodiment of FIG. 10.

FIGS. 14A-14D illustrate various views and features of another representative embodiment of a drill bit 1400 that is configured for a reverse flow of drilling fluid. This embodiment is different from the previous embodiment in that there are only five cutters 1402 mounted into cutter receptacles that are spaced about a cutting head 1404, and which cutters 1402 are positioned in an annular arrangement that surrounds a single large aperture 1406 located in the center portion of the cutting head 1404. As with the previous reverse flow embodiment, the single aperture 1406 can be sized to receive any fragments, cuttings, chips and other detritus produced by the cutting head 1404 and to convey the loose material into an inner bore 1408 of the drill bit 1400, and from thence up the fluid passage in the drill string to the surface. In one aspect, the total cross-sectional area of the single aperture 1406 can range from about seventy percent to about one hundred percent of the total cross-sectional area of the inner bore 1408 of the drill bit 1400.

Figure 14A:
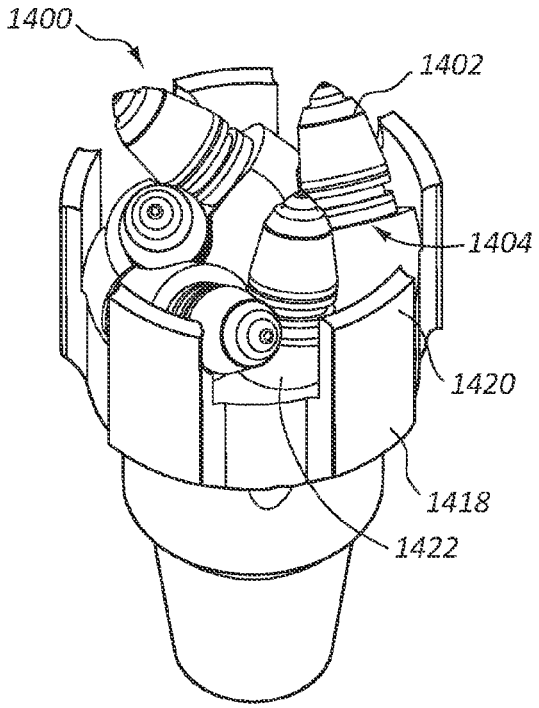
FIG. 14A is a perspective view of a drill bit, in accordance with another representative embodiment.
Figure 14B:
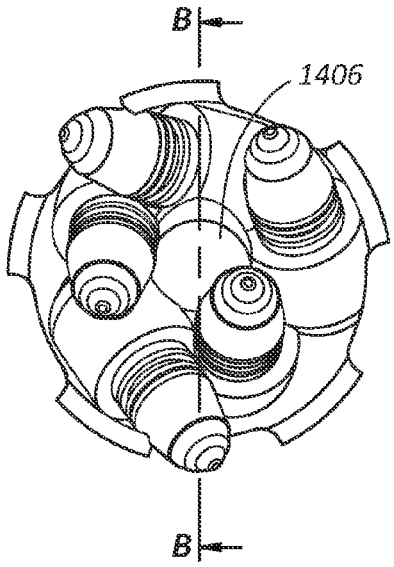
FIG. 14B is a top view of the embodiment of FIG. 14A.
Figure 14C:
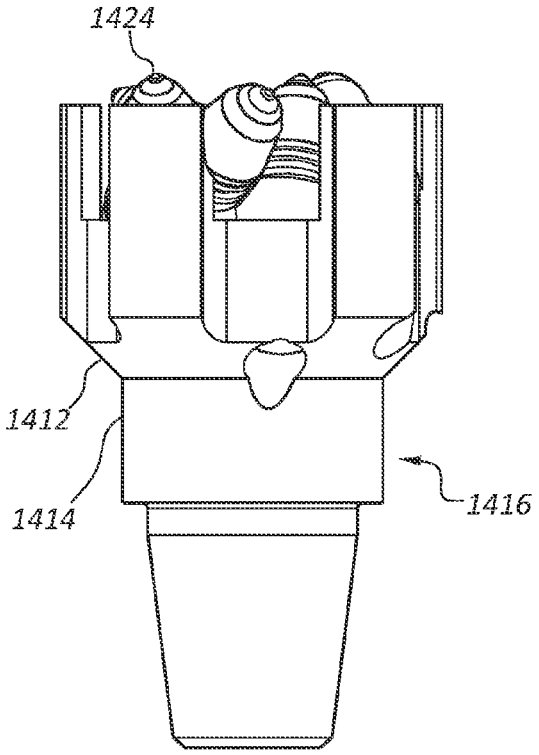
FIG. 14C is a side view of the embodiment of FIG. 14A.
Figure 14D:
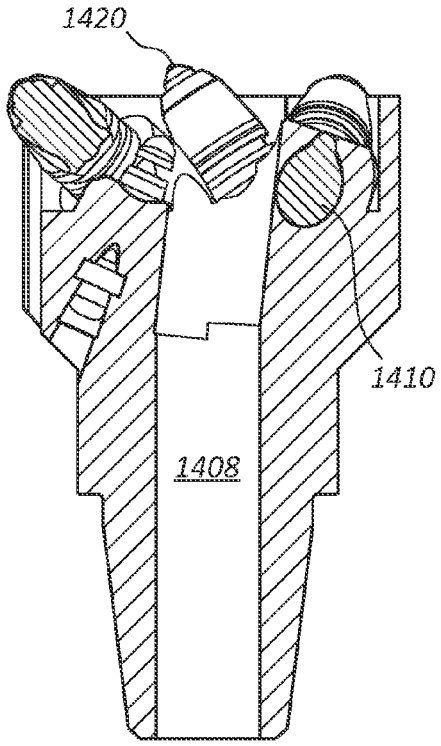
FIG. 14D is a cross-sectional side view of the embodiment of FIG. 14A, as viewed from section line B-B in FIG. 14B.
Figure 15A:
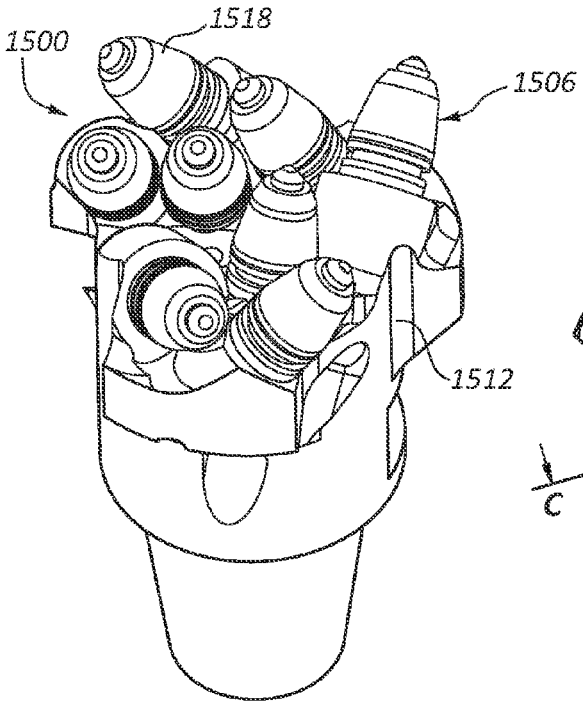
FIG. 15A is a perspective view of a drill bit, in accordance with another representative embodiment.
Figure 15B:
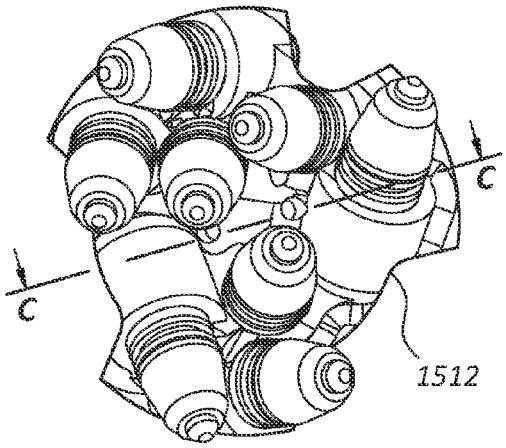
FIG. 15B is a top view of the embodiment of FIG. 15A.
Figure 15C:
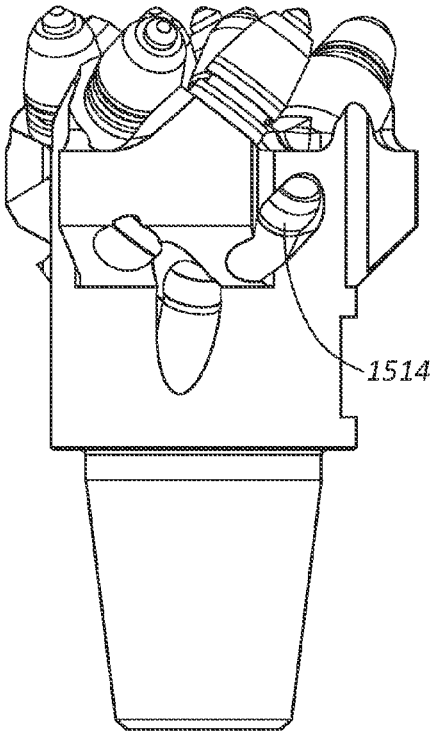
FIG. 15C is a side view of the embodiment of FIG. 15A.
Figure 15D:
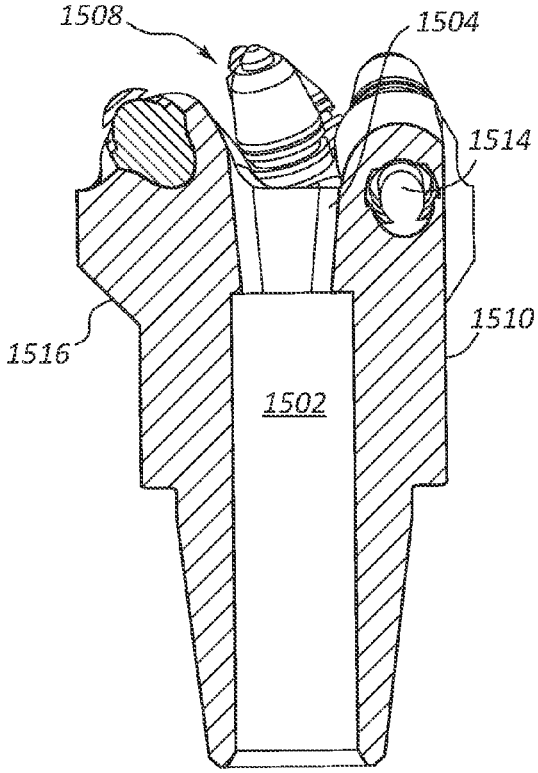
FIG. 15D is a cross-sectional side view of the embodiment of FIG. 15A, as viewed from section line C-C in FIG. 15B.
Figure 16A:
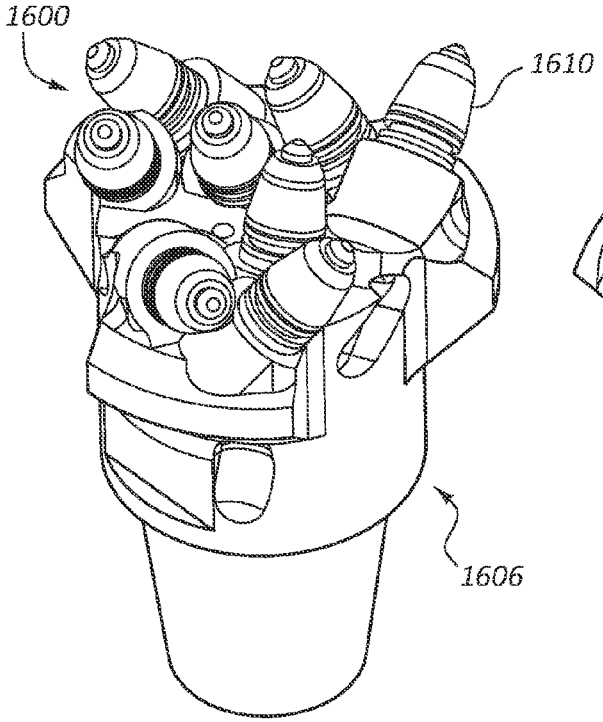
FIG. 16A is a perspective view of a drill bit, in accordance with another representative embodiment.
Figure 16B:
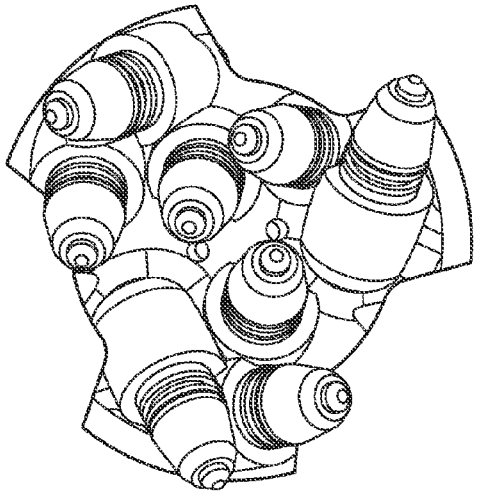
FIG. 16B is a top view of the embodiment of FIG. 16A.
Figure 16D:
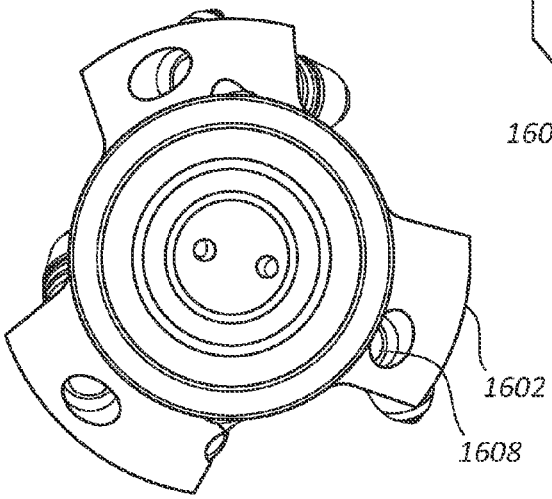
FIG. 16D is a bottom view of the embodiment of FIG. 16A.
Figure 16C:
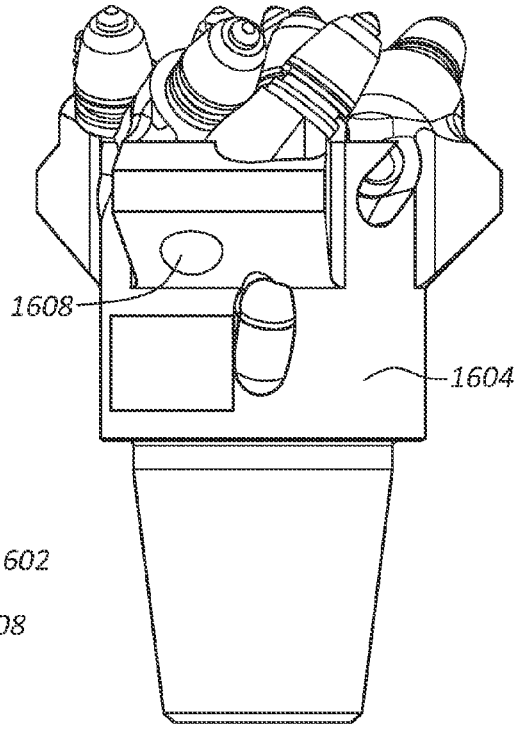
FIG. 16C is a side view of the embodiment of FIG. 16A.

As can also be seen in FIGS. 14C-14D, cutter receptacles 1410 can be through holes that extend through the perimeter portion of the cutting head 1404 to exit from a crown chamfer 1412 near a middle section 1414 of a bit body 1416, and thereby provide access to the base end of the cutters 1402 which been installed into the cutter receptacles 1410. This feature may allow for the removal of the cutters 1402 from the cutter receptacles 1410 in a field location, such as a mine, oil rig, or other well-site. In one embodiment, for instance, the cutters 1402 can be initially installed into the cutter receptacle with a press or shrink fit which securely holds the cutters 1402 in place during use, but which can still allow for the cutters 1402 to be punched out from the back end of the cutter receptacles 1410 with a punching tool. Thus, the cutters 1402 can be replaced in the drill bit 1400 in order to repair damaged or broken cutters 1402, or to change one type of cutter 1402 that is suitable for a particular hard material or formation for those of another cutter 1402 type that is more suitable for drilling through a different hard material or formation. Consequently, the purpose and capability of a particular drill bit 1400 can be adjusted in the field by changing the cutters 1402, thereby making the drill bit 1400 more cost-effective and useful.

Also shown in the embodiment of FIGS. 14A-14D is an extension 1420 of an outer radial surface 1418 forwardly from an axial location proximate the cutter receptacle 1410 to an axial location proximate the cutter tips 1424, thereby forming extended skirting up the side of the cutting head 1404. In this embodiment, junk slots 1422 can extend inwardly from the outer radial surface 1418 to divide the extended skirting into blades. The extended skirting can be used to more precisely define the size and shape of the junk slots 1422 and the cutting space or volume between the cutting face of the drill bit 1400 and the end face of the borehole, and thereby control the flow of drilling fluid into and through this volume. As with the previous embodiment described above, the total cross-sectional area of the junk slots 1422 may be less than the total cross-sectional area of the single aperture 1406 in the cutting head 1404, so as to control the velocity of the cutting fluid as it enters the cutting space from the perimeter of the cutting face.

Illustrated in FIGS. 15A-15D is another representative embodiment of a drill bit 1500 that is configured for a standard flow of drilling fluid. In this configuration the drilling fluid can be pumped through the fluid passage of the drill string to an inner bore 1502 of the drill bit 1500, and from thence out through one or more apertures 1504 formed into the cutting head 1506. As can be seen in cross-sectional view of FIG. 15D, the apertures 1504 between the inner bore 1502 and the cutting face 1508 of the bit body 1510 can be narrowed into nozzles that operate to direct high-velocity jets of drilling fluid against the end face of the borehole. Likewise, junk slots 1512 which extend radially inward from the outer radial surface of the cutting head 1506 can be increased in size and cross-sectional area to accommodate the fragments, cuttings, chips and other detritus produced by the cutting head 1506 as it drills through the hard material.

As with the embodiment described above in reference to FIGS. 14A-14D, cutter receptacles 1514 spaced about the cutting head 1506 of the drill bit 1500 of FIGS. 15A-15D may be through holes that extend through the perimeter portion of the cutting head 1506 to exit from a crown chamfer 1516 near the middle section of the bit body 1510, and which may allow for either fixed or rotating cutters 1518, as well as for the removal and replacement of the cutters 1518 in a field location.

FIGS. 16A-16D illustrate various views and features of another representative embodiment of a drill bit 1600 that similar to the embodiment shown in FIGS. 15A-15D, except that it is slightly larger and has a perimeter section or blades 1602 which project radially outward beyond the middle section 1604 of the bit body 1606 in a more prominent fashion. As can be seen, this embodiment of the drill bit 1600 is also configured for standard flow and includes cutter receptacles 1608 having through holes, allowing for either fixed or rotating cutters 1610, as well as the removal and replacement of the cutters 1610 in a field location.

Figure 17A:
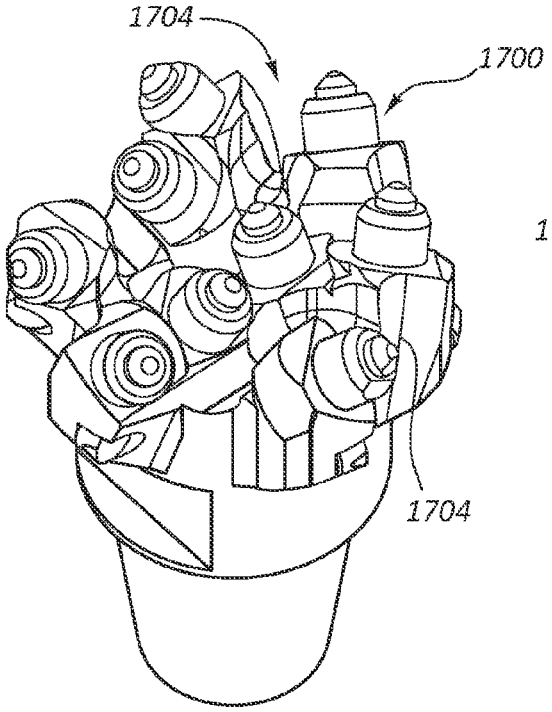
FIG. 17A is a perspective view of a drill bit, in accordance with another representative embodiment.
Figure 17B:
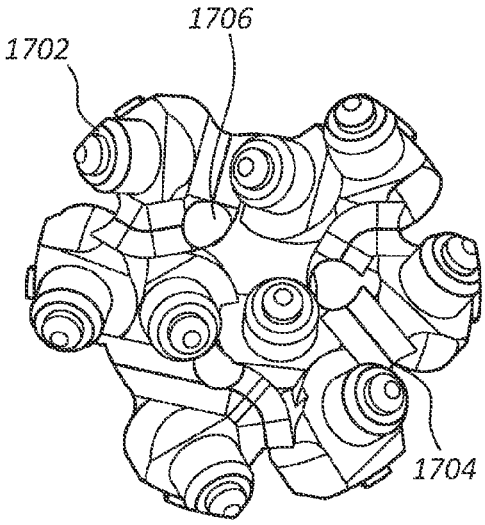
FIG. 17B is a top view of the embodiment of FIG. 17A.
Figure 17C:
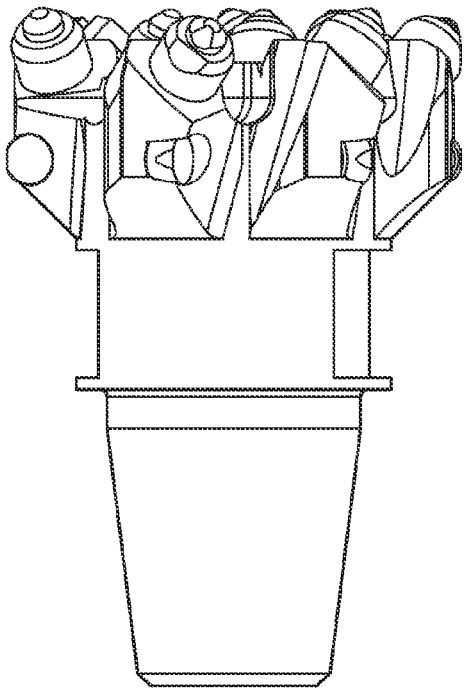
FIG. 17C is a side view of the embodiment of FIG. 17A.
Figure 18:
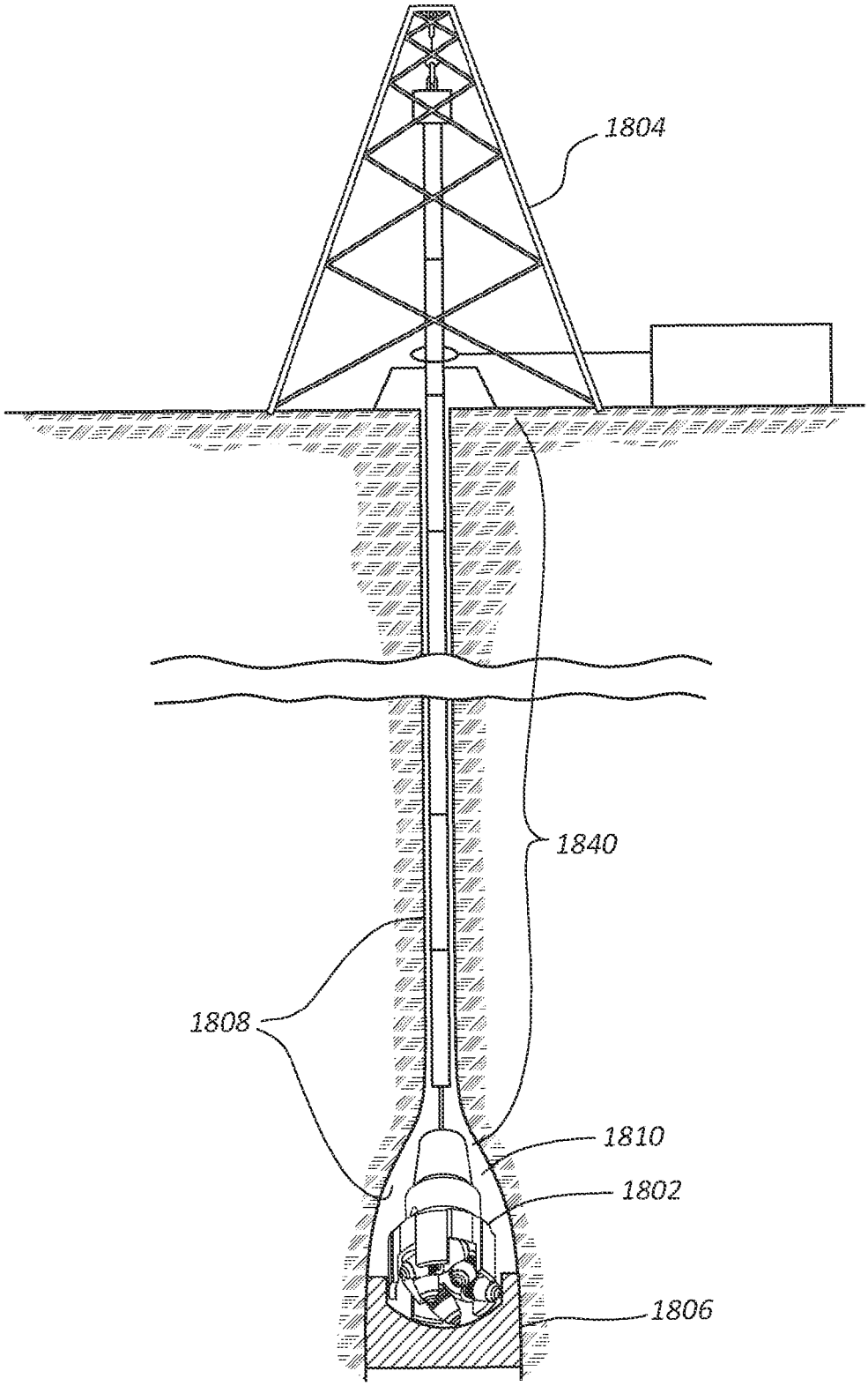
FIG. 18 is a schematic side view of a drill bit coupled to the lower end of a drill string, in accordance with another representative embodiment.

Illustrated in FIGS. 17A-17C is yet another representative embodiment of a drill bit 1700 that is configured for standard flow of the drilling fluid, but with cutter receptacles that include blind holes for receiving and holding the cutters 1702 with a press fit or a braze joint that create a fixed, non-rotating connection between the cutters 1702 and the cutting head 1704. In addition, the number and arrangement of the cutters 1702 mounted within the cutting head 1704 is similar with the first embodiment illustrated and described with reference to FIGS. 1-6, except that the junk slots 1704 which extend inwardly from the outer radial surface are both larger and more deeply swept around the cutting edge of the cutting head 1704 to continue across the cutting face of the bit body, so as to better channel and control the drilling fluid exiting through the three apertures 1706 in the center portion of the cutting head 1704.

Methods of building a drill bit that fall within the scope of the disclosure are also described. A bit body is formed with one or more blades connected thereto that extend radially and outwardly past the middle section of the bit body. The blades can be formed integrally with the bit body, such as with the junk slots being milled out of a single steel blank to divide the perimeter portion of the cutting head into blades. Alternatively, the drill bit blades can be welded to the bit body. Another embodiment of the bit body and blades is one formed of a matrix sintered in a mold of selected size and shape under temperature and pressure, typically a tungsten carbide matrix with a nickel binder, with the blades also being integrally formed of the matrix with the bit body. A steel blank in the general shape of the bit body and the blades can be used to form a scaffold and/or support structure for the matrix.

The bit body can be attached, joined, or fixedly coupled to a connection means, such as the pin connection described above, which is configured to connect the drill bit to a drill string, downhole motor, or other means of applying a rotary force or torque to the drill bit. The connection means can be formed integrally with the bit body from a single steel blank, or a steel connection can be welded to the middle section bit body subsequent to the formation of the cutting head.

The inner bore of the drill bit can be milled out of the bit body. Likewise, the nozzles, jets, ports, fluid channels and junk slots within the drill bit body, and one or more cutter receptacles, whether blind holes or through holes, can also be milled out of the drill bit body. Alternatively, if the drill bit is formed from a matrix, special blanks may be placed within the mold at the location of the various features, such as the jets, nozzles, fluid channels, junk slots, and cutter receptacles or through holes with the matrix sintered about the blanks Once the drill bit body is removed from its mold after the sintering process the blanks can be removed from the drill bit body, thereby revealing the desired hole or feature in the drill bit body. Any imperfections in the molding process can be removed through finish milling or other similar tool work.

Cutters configured to be received in the cutter receptacles are also provided, with the cutters and/or cutter receptacles including a means of securing the cutters within the receptacles.

Optional features such as trim or gauge cutters can be positioned in either pockets milled or molded to receive them. Hard facing is optionally applied in various locations, as is any selected gauge protection.

The one or more present inventions, in various embodiments, includes components, methods, processes, systems and/or apparatus substantially as depicted and described herein, including various embodiments, sub-combinations, and subsets thereof. Those of skill in the art will understand how to make and use the present invention after understanding the present disclosure.

The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate representative embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A drill bit for drilling a hole through earth and hard materials, said drill bit comprising:

a bit body having a first end, a second end spaced apart from said first end, a middle section between said first end and said second end, said bit body having a longitudinal axis, said bit body including a bore extending from said first end towards said second end;

a connection means configured to couple said bit body to a rotation means for providing rotational torque to said bit body, said connection means being located at said first end;

a cutting head at said second end, said cutting head including:

a center portion having at least one aperture extending from said second end to said bore;

a perimeter portion projecting radially outwardly beyond said middle section, said perimeter portion having an outer radial surface, said perimeter portion having a plurality of junk slots extending inwardly from said outer radial surface to divide said perimeter portion into a plurality of blades;

a cutting face; and a plurality of cutter receptacles, said cutter receptacles being spaced about said cutting face; and a plurality of cutters, each of said cutters having a cutter tip centered about a cutter axis and terminating in a cutter point, each of said cutters being mounted into a cutter receptacle at an individual pitch angle relative to said cutting face and with said cutter tip being pointed in a direction of intended rotation of said drill bit, said pitch angle being measured between a reference line in the direction of intended rotation in the plane perpendicular to said longitudinal axis of said bit body and said cutter axis, said individual pitch angles each being an acute angle opening away from said reference plane, wherein at least one cutter has a first individual pitch angle different from at least one other cutter; and said plurality of cutter points together defining a projected cutting surface.

2. The drill bit of claim 1, wherein said projected cutting surface is substantially flat.

3. The drill bit of claim 1, wherein said projected cutting surface is substantially concave.

4. The drill bit of claim 1, wherein said projected cutting surface is substantially convex.

5. The drill bit of claim 1, wherein said cutter tips are substantially conical.

6. The drill bit of claim 5, wherein said cutter tips comprise an included angle of less than about ninety degrees.

7. The drill bit of claim 1, wherein said plurality of cutters comprise:

a plurality of inner cutters, said inner cutters being distributed about said cutting face; and a plurality of outer cutters, said outer cutters being distributed around a perimeter of said cutting face with the cutter tips of said outer cutters extending radially beyond said outer radial surface to cut a sidewall of said hole.

8. The drill bit of claim 7, wherein at least one third of said plurality of cutters are outer cutters.

9. The drill bit of claim 7, further comprising a plurality of gauge cutters positioned about said outer radial surface.

10. The drill bit of claim 9, wherein the cutter points of said outer cutters extend radially beyond said gauge cutters.

11. The drill bit of claim 1, wherein each of the individual pitch angles ranges from fifty degrees to eighty-five degrees.

12. The drill bit of claim 11, wherein a pitch angle for a first cutter mounted within said center portion of said cutting head is greater than a pitch angle for a second cutter mounted within or adjacent to said perimeter portion.

13. The drill bit of claim 11, wherein a pitch angle for a first cutter mounted within said center portion of said cutting head is eighty-five degrees and for a second cutter mounted within or adjacent to said perimeter portion is fifty degrees.

14. The drill bit of claim 1, wherein the individual pitch angles comprise a plurality of different pitch angles, wherein said individual pitch angle is dependent upon a projected helix angle for a cutter location of each cutter.

15. The drill bit of claim 1, wherein a cross-sectional area of said at least one aperture is at least about ninety percent of a cross-sectional area of said bore of said bit body.

16. The drill bit of claim 1, wherein said at least one aperture is sized and configured to receive a reverse flow of drilling fluid therethrough.

17. The drill bit of claim 1, wherein a combined cross-sectional area of said plurality of junk slots is equal to or less than a cross-sectional area of said at least one aperture of the cutting head.

18. The drill bit of claim 1 further comprising at least one cylindrical cutter disposed on said cutting head, said at least one cylindrical cutter comprising a cylindrical body and a substantially flat, hardened face.

19. The drill bit of claim 18 wherein said substantially flat, hardened face comprises a polycrystalline diamond compact.

20. The drill bit of claim 1, wherein the individual pitch angles comprise a plurality of different pitch angles, wherein each of said individual pitch angles is dependent upon a preferred attack angle for each cutter and projected helix angle for a cutter location of each cutter, the projected helix angle based on a rotational speed of the drill bit about the longitudinal axis greater than 150 revolutions per minute.

* * * * *